US011786803B2

(12) United States Patent
Vicente

(10) Patent No.: US 11,786,803 B2
(45) Date of Patent: Oct. 17, 2023

(54) INFLATABLE SKATEBOARDING RAMP

(71) Applicant: PRO ACTIVATIONS LLC, San Diego, CA (US)

(72) Inventor: Oriol Vicente, San Diego, CA (US)

(73) Assignee: PRO ACTIVATIONS LLC, San Diego, CA (US)

( * ) Notice: Subject to any disclaimer, the term of this patent is extended or adjusted under 35 U.S.C. 154(b) by 0 days.

(21) Appl. No.: 17/401,275

(22) Filed: Aug. 12, 2021

(65) Prior Publication Data

US 2022/0323851 A1 Oct. 13, 2022

(30) Foreign Application Priority Data

Apr. 9, 2021 (ES) ..... ES202130313

(51) Int. Cl.
*A63C 19/00* (2006.01)
*A63G 31/12* (2006.01)

(52) U.S. Cl.
CPC ..... *A63C 19/00* (2013.01)

(58) Field of Classification Search
CPC ..... A63C 19/00; A63C 19/04; A63C 2203/16; A63G 31/00; A63G 31/12
USPC ..... 472/92–94, 134, 89; 104/69.5
See application file for complete search history.

(56) References Cited

U.S. PATENT DOCUMENTS

| | | | | |
|---|---|---|---|---|
| 6,623,367 | B1 | 9/2003 | Labelson | |
| 6,654,977 | B1 | 12/2003 | Chin | |
| 2002/0183124 | A1 | 12/2002 | Edward et al. | |
| 2007/0101488 | A1* | 5/2007 | Ferraro, Sr. | A63G 21/18 4/496 |
| 2009/0239670 | A1 | 9/2009 | Ream | |
| 2010/0050348 | A1 | 3/2010 | Mapp | |
| 2018/0318701 | A1 | 11/2018 | Merlot | |
| 2019/0001228 | A1* | 1/2019 | Schmit | A63G 21/18 |

FOREIGN PATENT DOCUMENTS

| | | |
|---|---|---|
| DE | 3524494 | 1/1987 |
| WO | WO 2015024137 | 2/2015 |

OTHER PUBLICATIONS

Spanish Patent Office Search Report dated Oct. 6, 2021 issued in application 202130313 (7 pages).
International Search Report and Written Opinion issued in PCT/ES2022/070187 dated Jul. 21, 2022, and translation thereof.
Response to Spanish Patent Office Search Report dated Oct. 6, 2021 issued in application 202130313, and English Translation thereof.

* cited by examiner

*Primary Examiner* — Kien T Nguyen
(74) *Attorney, Agent, or Firm* — ARC IP LAW, PC; Joseph J. Mayo

(57) ABSTRACT

Inflatable skateboarding ramp with an inflatable base that gives shape to the ramp, a semi-rigid surface located on the upper face of the inflatable base with one or two entrance platforms, as well as a rolling area and means for fixing the semi-rigid surface and the inflatable base.

16 Claims, 6 Drawing Sheets

INFLATABLE SKATEBOARDING RAMP

This application claims priority to Spanish Utility Patent Application Serial No. 202130313, filed 9 Apr. 2021, the specification of which is hereby incorporated herein by reference.

BACKGROUND OF THE INVENTION

Field of the Invention

One or more embodiments of the invention are related to the field of fixtures for sporting activities.

More specifically, but not by way of limitation, one or more embodiments of the invention enable a skateboarding ramp made from one or more inflatable bodies that, due to its particular arrangement, allows the construction and configuration of circuits for the practice of skateboarding, in a wide range of shapes and dimensions, and with endless possible combinations of different independent modules.

Description of the Related Art

The classic skate ramps are known in the current state of the art, usually built entirely or partially with cement, wood, plastic or metal and of a mostly permanent nature or with a certain complexity for disassembly and transportation.

Conventional skateboarding ramps have a complex configuration with heavy and rigid materials that make their installation, removal and transport a complicated and expensive task, in many cases they are permanent in nature without the possibility of relocation.

Said nature of a permanent or semi-permanent structure entails limitations on the use of spaces, and obliges its owners to dedicate a considerable space for the exclusive use of the skateboard ramp.

Conventional skateboarding ramps have a complex configuration with heavy and rigid materials that require a hard support surface and completely flat to ensure proper use.

It is also common for such structures to require foundations or certain ground preparation work before installing the ramp.

Conventional skateboarding ramps have a rigid configuration and this is a common cause of significant injuries to participants. The materials used do not provide any type of impact attenuation.

One or more embodiments of the invention contribute to solving the present problem,
as it allows the installation and removal of the skateboarding ramp in a matter of a few minutes, it is easy to transport and can be installed on any surface that is flat, including in water as a floating structure.

One or more embodiments of the invention also offer a configuration of materials that provide substantial impact attenuation and cushioning, thereby reducing risk of serious injury to participants.

BRIEF SUMMARY OF THE INVENTION

One or more embodiments of invention provide a system for the construction of ramps for the practice of sports such as skateboards, scooters, skates and bicycles, which allow an easy and fast installation and removal, without the need for any type of site preparation work, being able to install both on firm ground and on water.

The new ramp consists of an inflatable base that gives shape and body to the ramp in question, on which a semi-rigid surface is attached in which one or two entrance platforms are distinguished and a rolling area that allows a correct wheel rolling of skateboards, scooters, skates and bicycles.

The new inflatable ramp can be established as an independent ramp or incorporate means of coupling with other ramps, which allows the assembly of circuits with several ramps where participants can transition or jump from one ramp to the other.

The coupling means between ramps facilitate that at least one of their adjacent faces is held together by the adjoining ramp or ramps through securing means preferably of a conventional type such as webbing, straps or hook and loop closures type Velcro®.

The semi-rigid surface is coupled to the inflatable base through means of fixing the surface constituted by fixing elements arranged on the upper face of the inflatable base in correspondence to complementary fixing elements arranged on the lower face of the semi-rigid plates that make up the semi-rigid surface.

The securing means of the semi-rigid surface are preferably based on hook-and-loop Velcro®-type fasteners and hold both the rolling area and the entry platforms firmly in position to facilitate the practice of skateboarding.

Whether it is simple ramps or combinable ramps, the inflatable base has fixing means to the ground.

These fixing means to the ground are preferably constituted as skirts integral with the inflatable base that extend over the ground and on which ballast elements or fixing pins are placed.

Alternatively, these skirts can be replaced by straps or tensioning straps.

Additionally, the inflatable base incorporates ballast chambers or compartments designed to be filled with water, or another liquid, which increase the stability of the inflatable structures on the ground.

The ballast compartments can be located both inside the inflatable base or outside.

In embodiments where the ramp is installed floating on water, buoyancy compartments or chambers are incorporated that present a configuration whose design allows the use of the ramp as a floating structure. In such a case, the compartments or chambers are filled with air and sized appropriately for weight and volume of the structure to be supported over the water.

In order to install the device on uneven terrain, the ramp incorporates a system of leveling chambers located on the lower face of the inflatable base that can be selectively inflated with air to achieve leveling of the ramp and thus allow the practice of the activity without the need to modify the terrain.

Said compartments or chambers can be constructed of the same material as the inflatable base.

By combining different modular ramps, the generation and configuration of a network of ramps and transition modules is achieved, and therefore the possibility of assembling said modules in different order in order to create endless different circuits.

This makes it the first inflatable and modular skate park that can be easily reconfigured and thus gives options to create a very wide variety of paths.

Illustrative operation of one or more embodiments of the invention is described below:

The ramps adopt a suitable configuration and geometric shape for use after inflating the inflatable base through suitable valves, and after coupling the semi-rigid plates that make up the semi-rigid surface to the inflatable base by means of the surface fixing elements.

In this situation, the entrance platforms are located at a higher level than the rolling area, in a configuration commonly known as a "halfpipe" or "quarterpipe", but they can have an endless number of shapes and sizes according to each design.

In a deflated situation, the ramp is out of use and the inflatable base, as well as the semi-rigid plates that make up the semi-rigid surface, once removed from the inflatable base, can be easily folded and stored.

No permanent or rigid structure is required to create or give support to the inflatable ramp.

By using inflatable technology, it allows to create a safer ride, easy to install and uninstall, and completely portable.

The combination of inflatable technology with a rolling surface made of a semi-rigid material enables the practice of these sports.

DETAILED DESCRIPTION OF THE INVENTION

Figure 1:
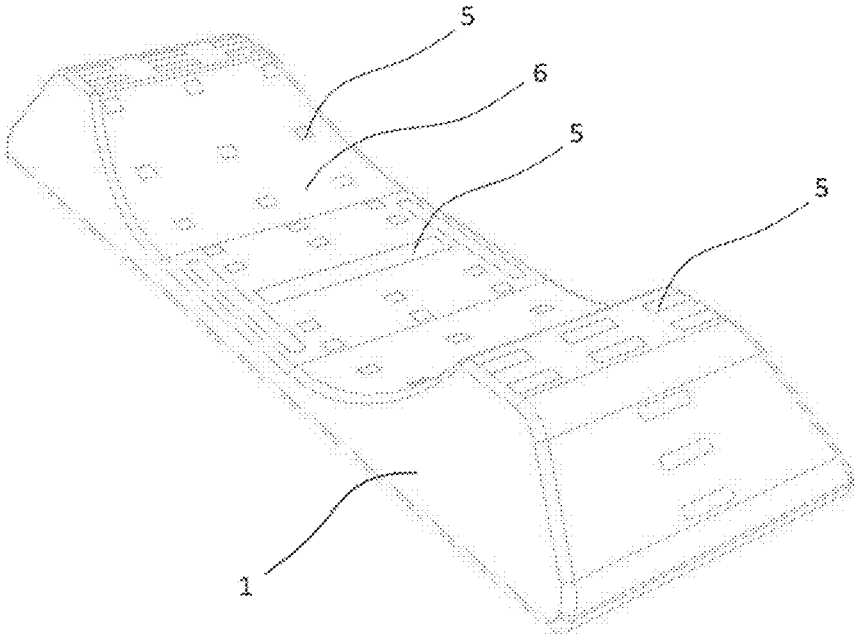
FIG. 1.—Isometric view showing an inflatable base already inflated in which the fixing elements, for the semi-rigid surface, can be seen arranged on the upper face.
Figure 2:
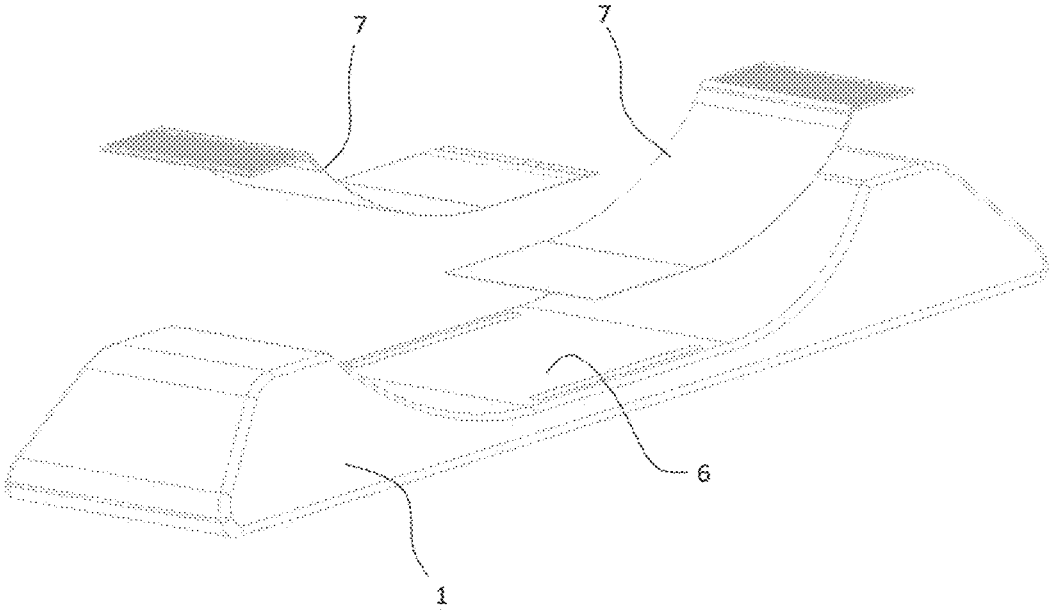
FIG. 2.—Exploded isometric view of the new ramp showing the inflatable base with two semi-rigid plates that constitute the two entrance platforms and one rolling area of the semi-rigid surface.
Figure 3:
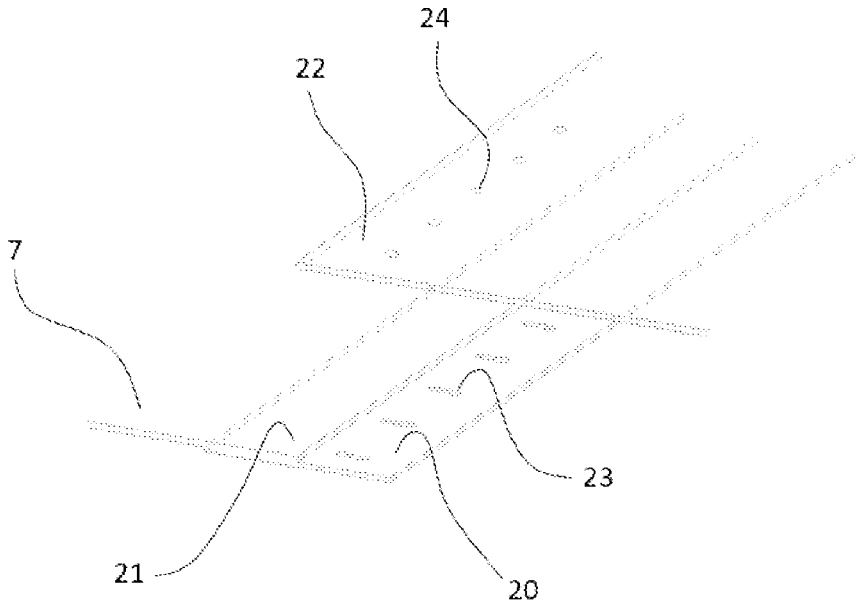
FIG. 3 and FIG. 3A.—Detailed views of the rolling area in which the design of the overlap joint of the two semi-rigid plates can be seen, which guarantees the continuity and adjustment of the rolling surface in any circumstance.
Figure 3A:
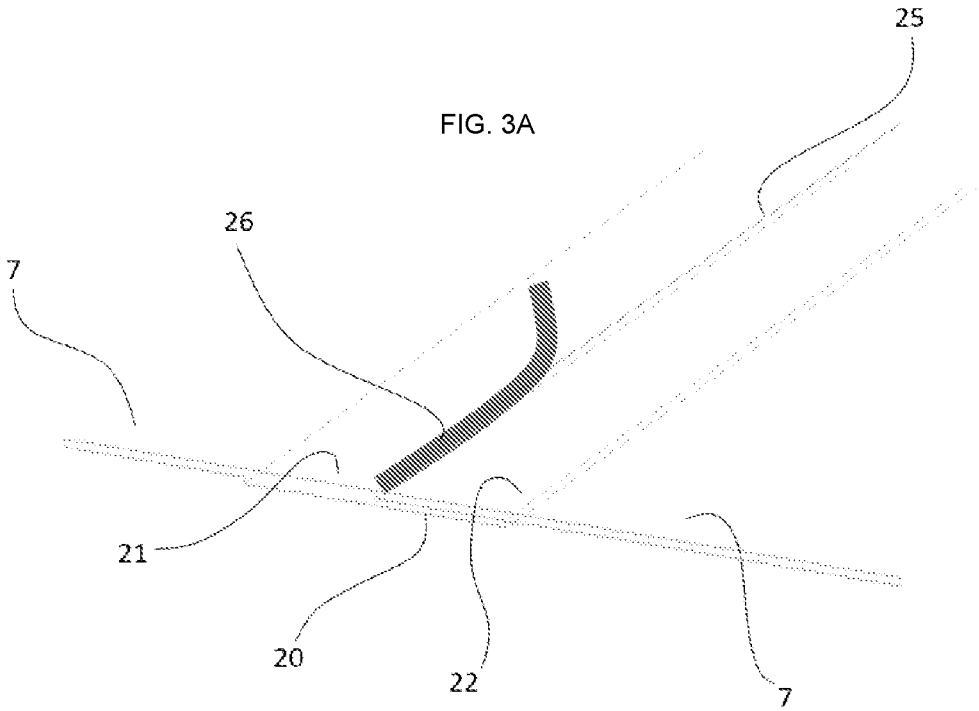
Figure 4:
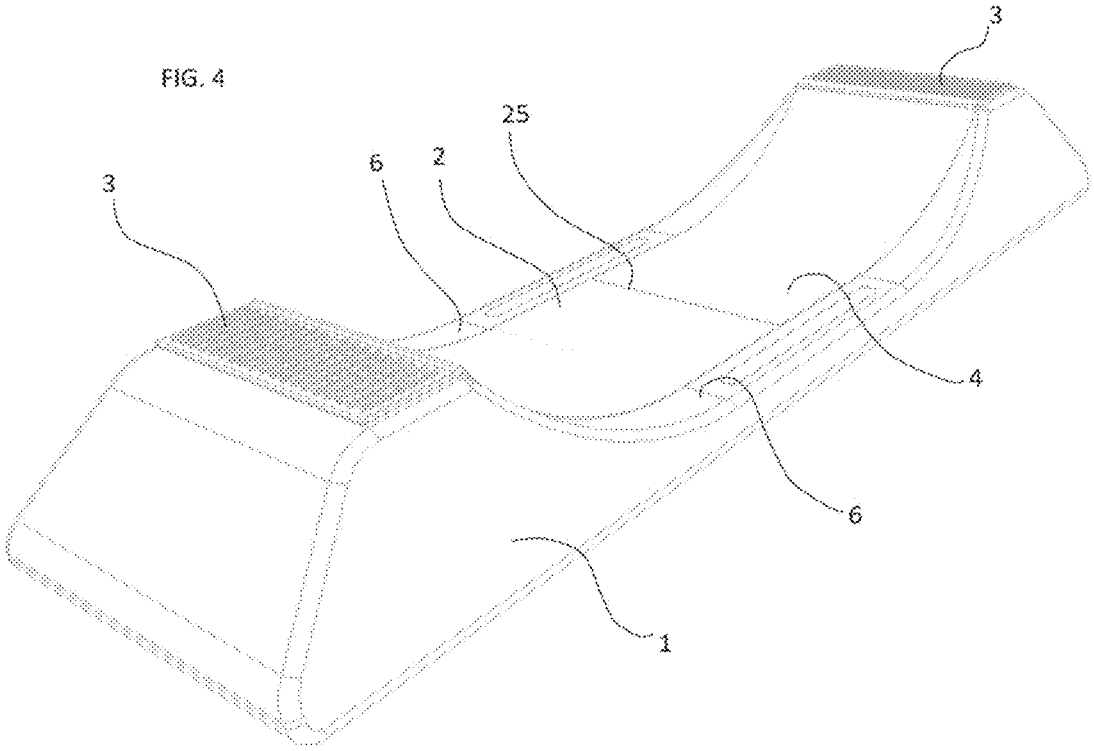
FIG. 4.—Isometric view of the ramp showing the inflatable base and the semi-rigid surface coupled in condition of use for the practice of the activity.
Figure 5:
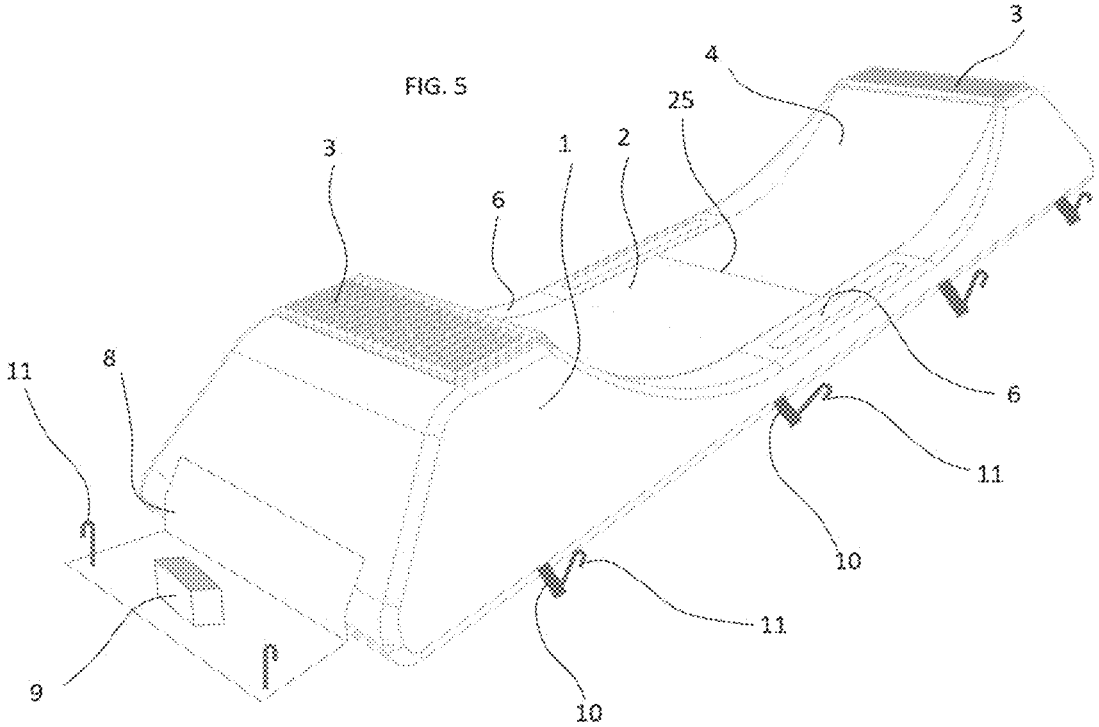
FIG. 5.—Isometric view of the ramp showing the fixing means to the ground.

As shown in the figures, the ramp according to one or more embodiments of the invention comprises an inflatable base (1) that gives shape to the ramp, on which a semi-rigid surface (2) is attached, in which we can distinguish the entrance platforms (3) and a rolling area (4).

Both the inflatable base (1) and the semi-rigid surface (2) can vary in their chemical composition or type of material, but the combination of these properties (flexible with semi-rigid "skin") is what validates the product.

The semi-rigid surface (2) and the inflatable base (1) are joined by means of fixing elements attached on each surface.

These surface fixing means are constituted, according to the examples shown, by fixing elements (5) arranged on the upper face (6) of the inflatable base (1) and in correspondence to complementary fixing elements arranged on the underside of the semi-rigid plates (7) that make up the semi-rigid surface (2).

The fixing elements (5) that constitute the fixing means of the semi-rigid surface can vary.

According to the illustrated example, the semi-rigid surface (2) is constituted by two semi-rigid plates (7) that are coupled in a joint line (25) located in the center of the rolling area (4). The union line (25) has a receiving edge (21) with a support area (20) that extends from the underside of the semi-rigid plate and on which a support edge (22) of the other semi-rigid plate rests to complete the joint.

To secure the position of the receiving edge (21) and the support edge (22), the support area (20) has a plurality of slits (23) located in correspondence with a plurality of pins (24) projecting from the bottom face of the support edge (22) which, in the assembly position, are inserted in the grooves (23) preventing displacement of the surfaces in contact. Thus, the semi-rigid plates (7) are perfectly aligned, then the joint line (25) is covered with an adhesive immobilizing band (26).

The inflatable base (1) has fixing means to the ground which in the illustrated example are made up of flaps (8) located at the ends of the ramp, on which ballast elements (9) are placed. The skirts (8) act in combination with straps (10) located in a spaced manner on the sides of the ramp, which are anchored to the ground by means of fixing pins (11).

Figure 6:
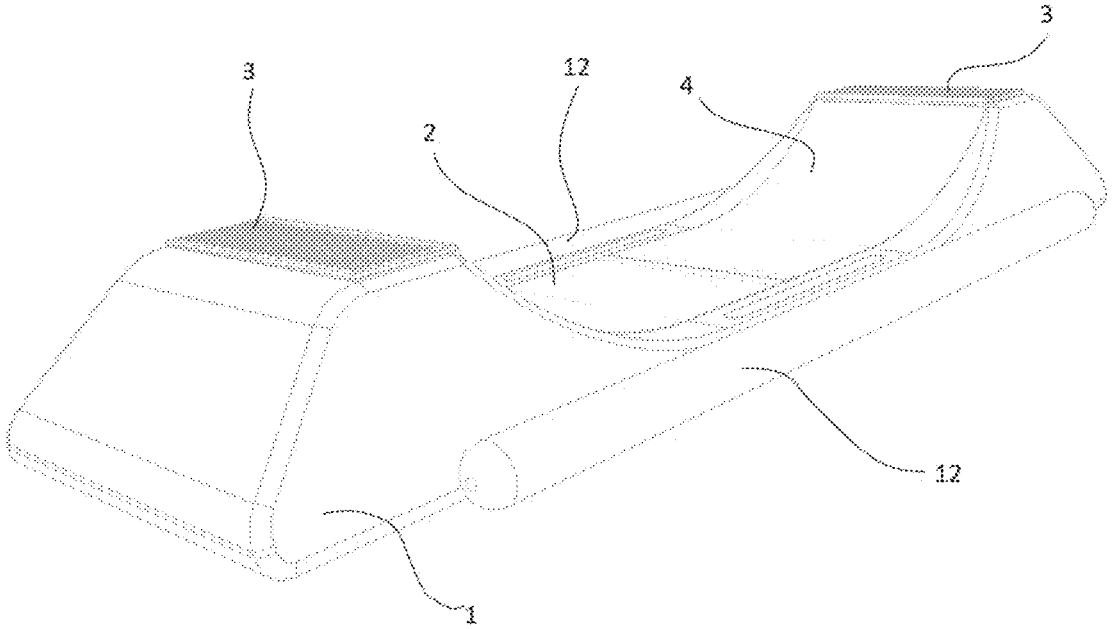
FIG. 6.—Isometric view of a version of the ramp according to an embodiment of the invention equipped with external ballast chambers or compartments.

In the embodiment shown in FIG. 6, the inflatable base (1) incorporates two external ballast chambers (12) that are filled with water to increase the stability of the inflatable structures on the ground.

Figure 7:
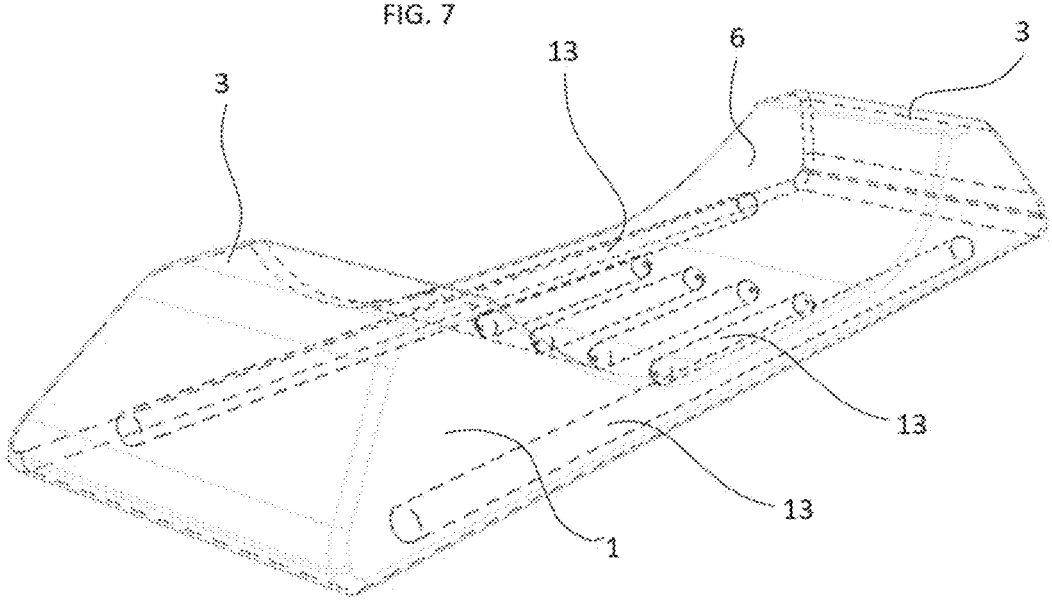
FIG. 7.—Isometric view of a version of the ramp according to an embodiment of the invention equipped with internal ballast chambers or compartments.

In the embodiment shown in FIG. 7, the inflatable base (1) incorporates six internal ballast chambers (13) that are filled with water to increase stability of the inflatable structures on the ground.

Figure 8:
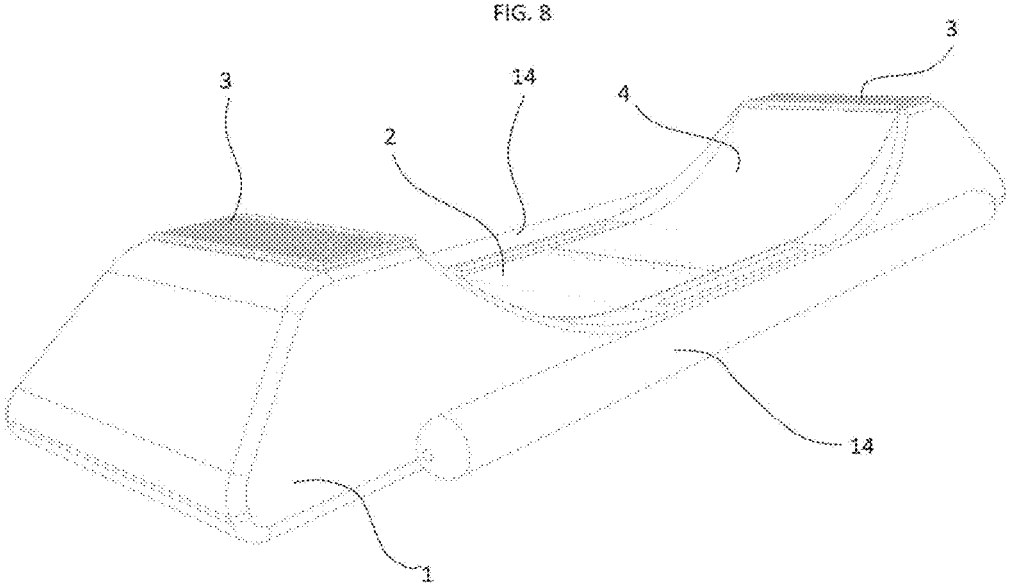
FIG. 8.—Isometric view of a version of the ramp according to an embodiment of the invention equipped with flotation chambers that present a configuration whose design allows the use of the ramp as a floating structure.

In the embodiment shown in FIG. 8, the inflatable base (1) incorporates two flotation chambers (14) that are filled with air for the use of the ramp as a floating structure.

Figure 9:
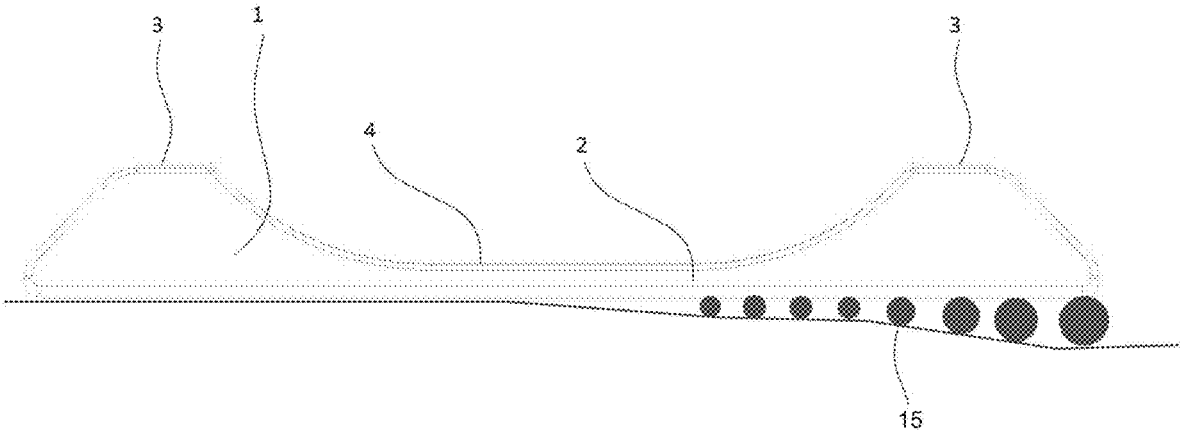
FIG. 9.—Side view of the new inflatable ramp in an installation that incorporates the leveling chambers system.

The ramp according to one or more embodiments of the invention incorporates a leveling system constituted by some leveling chambers (15) arranged on the lower face of the inflatable base (1) that inflate independently to level the ramp in cases of uneven terrain, as represented in FIG. 9).

The inflatable base (1) as well as the flotation chambers (14) and the leveling chambers (15) have valve means to allow their inflation and deflation, which may be one of those available on the market, so no further detail will be given in the description.

Figure 10:
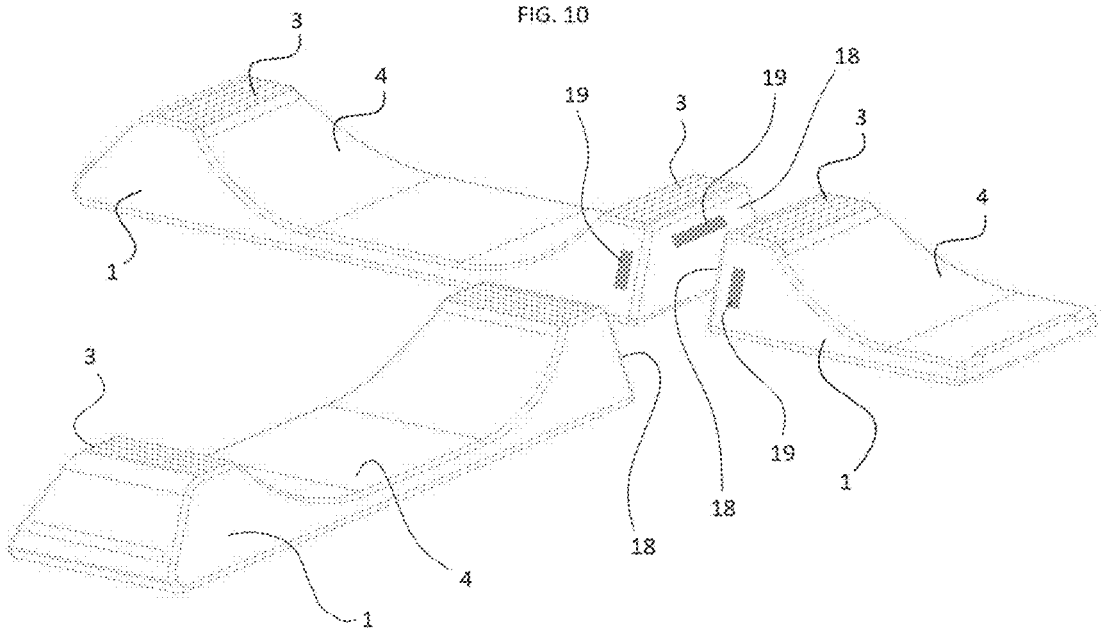
FIGS. 10 and 11—Are perspective views of an embodiment of the invention as a modular ramp in which a three-ramp circuit is shown.
Figure 11:
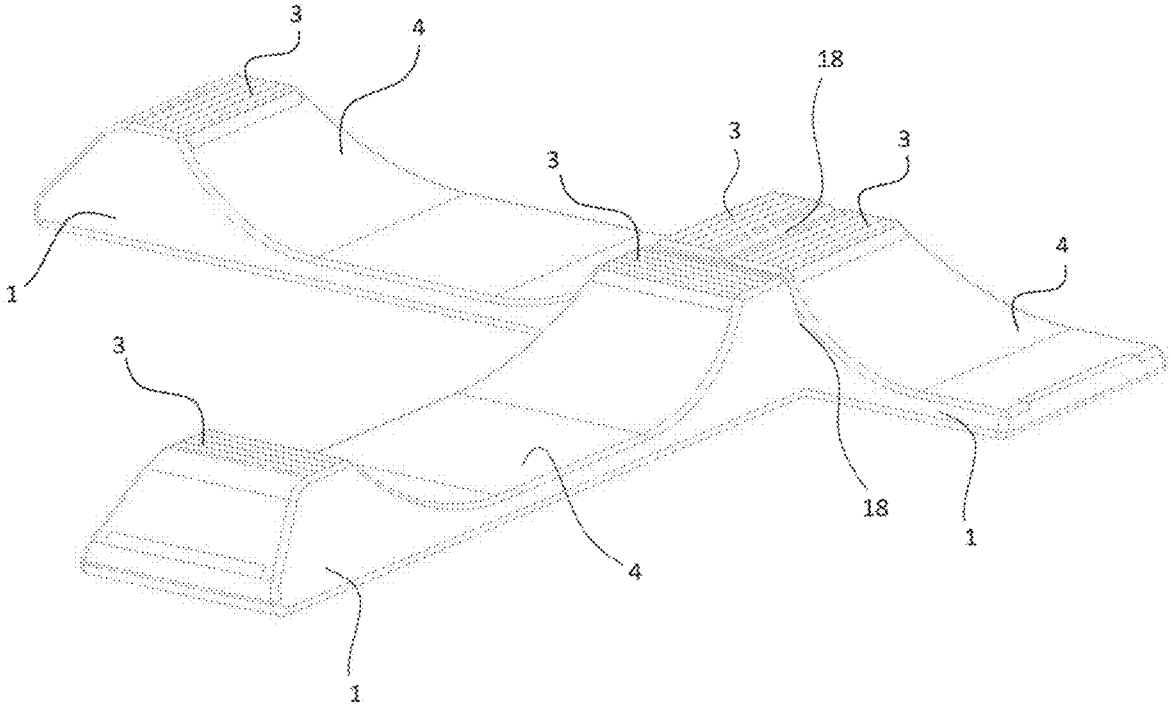

One or more embodiments of the invention allow the assembly of multiple ramp circuits as shown in FIGS. 10 and 11.

In this type of embodiment, the inflatable base (1) of each ramp has a configuration with one or both connectable ends (18), which allow coupling between ramps, keeping at least one of their adjacent faces (18) attached to that of the adjoining ramp by means of fastening between ramps (19), which may be one of those available in the market, so we will not go into greater detail in the description.

What is claimed is:

1. An inflatable skateboarding ramp comprising:

an inflatable base that gives shape to the inflatable skateboarding ramp;

a semi-rigid surface located on an upper face of the inflatable base, comprising one or two entrance platforms;

a rolling area;

a surface fixing means to fasten the semi-rigid surface to the inflatable base; and coupling means between two or more inflatable skateboarding ramps for assembling circuits of several ramps; and, wherein the coupling means adjoin at least one face of a first inflatable skateboarding ramp of said two or more inflatable skateboarding ramps to an adjacent face of a second inflatable skateboarding ramp, such that at least one entrance platform of said one or two entrance platforms of said first inflatable skateboarding ramp and an adjacent entrance platform of said one or two entrance platforms of a second inflatable skateboarding ramp of said two or more inflatable skateboarding ramps are side by side; and the coupling means comprise a fastening between the first inflatable skateboarding ramp and the second inflatable skateboarding ramp.

2. The inflatable skateboarding ramp of claim 1, wherein the semi-rigid surface comprises semi-rigid plates; and, the surface fixing means comprise fastening elements arranged on the upper face of the inflatable base in correspondence with complementary fastening elements arranged on a lower face of the semi-rigid plates.

3. The inflatable skateboarding ramp of claim 1, wherein the inflatable base comprises fixing means to ground.

4. The inflatable skateboarding ramp of claim 3, wherein the fixing means to ground comprise skirts or flaps integral with the inflatable base that extend on the ground and on which ballast elements are placed or fixing pins.

5. The inflatable skateboarding ramp of claim 3, wherein the fixing means to ground comprise straps or tensile straps that are anchored to the ground by fixing pins.

6. The inflatable skateboarding ramp of claim 1, wherein the inflatable base comprises ballast chambers to increase stability of the inflatable skateboarding ramp on ground.

7. The inflatable skateboarding ramp of claim 6, wherein the inflatable base has external ballast chambers configured to be filled with liquid.

8. The inflatable skateboarding ramp of claim 6, wherein the inflatable base has internal ballast chambers configured to be filled with liquid.

9. The inflatable skateboarding ramp of claim 1, wherein the inflatable base comprises flotation chambers configured to be filled with air, enabling use of the inflatable skateboarding ramp as a floating structure.

10. The inflatable skateboarding ramp of claim 1, comprising leveling chambers arranged on an underside of the inflatable base.

11. The inflatable skateboarding ramp of claim 1, wherein the semi-rigid surface comprises semi-rigid plates.

12. The inflatable skateboarding ramp of claim 11, wherein the semi-rigid plates are joined in a joint line in which edges of the semi-rigid plates converge, wherein the joint line is in a center of the rolling area.

13. The inflatable skateboarding ramp of claim 12, wherein the joint line comprises a receiving edge comprising a support zone that extends from a lower face of a first semi-rigid plate and on which an edge of an adjoining semi-rigid plate rests.

14. The inflatable skateboarding ramp of claim 13, wherein the support zone has a plurality of slits corresponding with a plurality of pins protruding from a lower face of the edge of the adjoining semi-rigid plate; and, said first semi-rigid plate is joined to said adjoining semi-rigid plate by inserting said plurality of pins into said plurality of slits, and applying an immobilizing adhesive band on the joint line.

15. The inflatable skateboarding ramp of claim 1, wherein the one or two entrance platforms are located at a higher level than the rolling area in a halfpipe configuration or a quarterpipe configuration.

16. The inflatable skateboarding ramp of claim 1, wherein at least one of said one or two entrance platforms of a first inflatable skateboarding ramp are coupled to an adjacent entrance platform of a second inflatable skateboarding ramp, configured to allow participants to transition from said first inflatable skateboarding ramp to said second inflatable skateboarding ramp via said one or two entrance platforms and said adjacent entrance platform.

* * * * *